US009525271B2

(12) United States Patent
Kataoka

(10) Patent No.: US 9,525,271 B2
(45) Date of Patent: Dec. 20, 2016

(54) SPARK PLUG

(71) Applicant: NGK SPARK PLUG CO., LTD., Nagoya-shi, Aichi (JP)

(72) Inventor: Yoshikazu Kataoka, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 14/779,752

(22) PCT Filed: Apr. 1, 2014

(86) PCT No.: PCT/JP2014/001906

§ 371 (c)(1),
(2) Date: Sep. 24, 2015

(87) PCT Pub. No.: WO2014/171088

PCT Pub. Date: Oct. 23, 2014

(65) Prior Publication Data

US 2016/0105000 A1 Apr. 14, 2016

(30) Foreign Application Priority Data

Apr. 17, 2013 (JP) ..... 2013-086562

(51) Int. Cl.
*H01T 13/20* (2006.01)
*H01T 13/39* (2006.01)
*H01T 21/02* (2006.01)

(52) U.S. Cl.
CPC ..... *H01T 13/39* (2013.01); *H01T 13/20* (2013.01); *H01T 21/02* (2013.01)

(58) Field of Classification Search
CPC ..... H01T 13/39; H01T 13/32
(Continued)

(56) References Cited

U.S. PATENT DOCUMENTS 5,239,225 A 8/1993 Moriya et al. ..... 313/141
5,440,198 A 8/1995 Oshima et al. ..... 313/141
(Continued)

FOREIGN PATENT DOCUMENTS

JP H03-176978 A 7/1991 ..... H01T 13/20
JP H-04138685 A 5/1992 ..... H01T 13/14
(Continued)

OTHER PUBLICATIONS

Office Action received in corresponding Japanese Patent Application No. 2014-542630, dated Nov. 10, 2015 (English translation provided.).

(Continued)

*Primary Examiner* — Vip Patel
(74) *Attorney, Agent, or Firm* — Kusner & Jaffe

(57) ABSTRACT

A spark plug with a center electrode, the center electrode having a small-diameter portion with a noble metal tip joined by laser welding to a front end of the small-diameter portion, a large-diameter portion made larger in diameter than the small-diameter portion and a connection portion connecting the small-diameter portion and the large-diameter portion to each other. In this spark plug, the following conditions (1), (2) and (3) are satisfied:

$$Dg \leq 2.6 \quad (1)$$

$$1.15 \leq Lc+Ls \leq 3.0 \quad (2)$$

$$0.48 \leq Ls/(Lc+Ls) \leq 0.75 \quad (3)$$

where Dg (mm) is a diameter of the large-diameter portion; Lc (mm) is a length of the noble metal tip in an axis direction of the spark plug; and Ls (mm) is a length of the small-diameter portion in the axis direction of the spark plug.

7 Claims, 7 Drawing Sheets

(58) Field of Classification Search
USPC ..... 313/141, 142
See application file for complete search history.

(56) References Cited

U.S. PATENT DOCUMENTS

| | | | | |
|---|---|---|---|---|
| 5,990,602 | A | 11/1999 | Katoh et al. | 313/141 |
| 7,109,646 | B2 | 9/2006 | Morita et al. | 313/141 |
| 8,354,782 | B2 | 1/2013 | Sakayanagi et al. | 313/141 |
| 8,878,424 | B2 | 11/2014 | Sumoyama et al. | 313/141 |
| 2004/0115976 | A1 | 6/2004 | Morita et al. | 439/101 |
| 2011/0148276 | A1 | 6/2011 | Sakayanagi et al. | 313/141 |
| 2012/0217864 | A1 | 8/2012 | Sumoyama et al. | 313/141 |

FOREIGN PATENT DOCUMENTS

| | | | | |
|---|---|---|---|---|
| JP | H05-335066 | A | 12/1993 | H01T 13/20 |
| JP | H06-36856 | A | 2/1994 | H01T 13/20 |
| JP | 2000-208235 | A | 7/2000 | H01T 13/16 |
| JP | 2000-243535 | A | 9/2000 | H01T 13/20 |
| JP | 2004-207219 | A | 7/2004 | H01T 13/20 |
| JP | 2005-150011 | A | 6/2005 | H01T 13/20 |
| JP | 2011-034826 | A | 2/2011 | H01T 13/16 |
| JP | 2012-182118 | A | 9/2012 | C22C 19/03 |

OTHER PUBLICATIONS

International Search Report issued in corresponding International Application No. PCT/JP2014/001906, dated Jul. 1, 2014.

| Ds (mm) | TIP WEAR AMOUNT (mm) |
|---|---|
| 0.5 (= Dc − 0.1) | 0.12 |
| 0.6 (= Dc) | 0.08 |
| 0.7 (= Dc + 0.1) | 0.07 |
| 0.8 (= Dc + 0.2) | 0.07 |
| 0.9 (= Dc + 0.3) | 0.06 |
| 1.0 (= Dc + 0.4) | 0.05 |
| 1.1 (= Dc + 0.5) | 0.05 |
| 1.2 (= Dc + 0.6) | 0.05 |

| Dg (mm) | IMPROVEMENT RATE |
|---|---|
| 2.6 | 0.12 |
| 2.3 | 0.08 |
| 2.1 | 0.07 |
| 1.9 | 0.07 |
| 1.7 | 0.06 |

| | X (mm) | 0 | 0.03 | 0.15 | 0.20 |
|---|---|---|---|---|---|
| COMPARATIVE EXAMPLE SAMPLE | TIME UNTIL BREAKAGE (sec) | 144 | 103 | 88 | 63 |
| EMBODIMENT SAMPLE | TIME UNTIL BREAKAGE (sec) | — | 152 | 138 | 112 |

| DIMENSIONS OF COMPARATIVE EXAMPLE SAMPLE | DIMENSIONS OF EMBODIMENT SAMPLE |
|---|---|
| Dc = 0.6 mm | Dc = 0.6 mm |
| Lc = 0.8 mm | Lc = 0.4 mm |
| Ds = 0.9 mm | Ds = 0.9 mm |
| Ls = 0.4 mm | Ls = 0.8 mm |
| Dg = 1.9 mm | Dg = 1.9 mm |

SPARK PLUG

RELATED APPLICATIONS

The present invention claims priority to Japanese Patent Application No. 2013-86562 filed on Apr. 17, 2013, hereby incorporated by reference in its entirety.

FIELD OF THE INVENTION

The present invention relates to a spark plug.

BACKGROUND OF THE INVENTION

A spark plug is used for ignition in an internal combustion engine such as gasoline engine. In general, the spark plug has a center electrode and a ground electrode with a gap for spark discharge (called "discharge gap") defined therebetween. In order to ensure good ignition performance, the center electrode usually includes a small-diameter portion located on a front end side (discharge gap side) thereof, a large-diameter portion located in rear of the small-diameter portion and made larger in diameter than the small-diameter portion and a connection portion connecting the small-diameter portion and the large-diameter portion to each other.

It has been proposed to provide the spark plug by laser welding an electrode tip, which is made of an alloy containing a noble metal (such as platinum, iridium, ruthenium or rhodium) of high resistance to spark wear and oxidation as a main component (hereinafter referred to as "noble metal tip"), to a front end (spark discharge region) of the small-diameter portion of the center electrode (see, for example, Japanese Laid-Open Patent Publication No. H6-36856; Japanese Laid-Open Patent Publication No. H3-176978; Japanese Laid-Open Patent Publication No. 2004-207219; Japanese Laid-Open Patent Publication No. 2005-150011; Japanese Laid-Open Patent Publication No. 2011-34826; and Japanese Laid-Open Patent Publication No. 2000-208235).

In the internal combustion engine, a higher compression ratio has been pursued in order to achieve not only high fuel efficiency by improvement of ignition performance but also high power output that runs counter to clean exhaust emission. There is however a problem that the risk of breakage of the center electrode increases due to increases in vibration and combustion pressure when the compression ratio of the internal combustion engine becomes high. In particular, the vibration of the center electrode is large so that there is a higher risk of breakage of the center electrode in the case where the large-diameter portion of the center electrode is relatively small in diameter.

In the case where the center electrode is constituted by the small-diameter portion with the noble metal tip joined thereto, the connection portion and the large-diameter portion as mentioned above, breakage is likely occur at a boundary region between the small-diameter portion and the connection portion of the center electrode. It is thus assumed that the breakage resistance of the center electrode will be improved by decreasing the axial length of the part of the center electrode situated in front of the boundary region, that is, the axial length of the part of the center electrode constituted by the small-diameter portion and the noble metal tip joined thereto. However, the ignition performance of the spark plug in the internal combustion engine deteriorates with decrease in the axial length of the part constituted by the small-diameter portion and the noble metal tip. In this way, there is a problem of achieving compatibility between improvement of the ignition performance of the spark plug and improvement of the breakage resistance of the center electrode.

SUMMARY OF THE INVENTION

The present invention has been made to solve the above problems and can be embodied by the following configurations.

[1] According to a first aspect of the present invention, there is provided a spark plug comprising a center electrode, the center electrode having a small-diameter portion with a noble metal tip joined by laser welding to a front end of the small-diameter portion, a large-diameter portion made larger in diameter than the small-diameter portion and a connection portion connecting the small-diameter portion and the large-diameter portion to each other, wherein the spark plug satisfies the following conditions (1), (2) and (3):

$$Dg \leq 2.6 \quad (1)$$

$$1.15 \leq Lc+Ls \leq 3.0 \quad (2)$$

$$0.48 \leq Ls/(Lc+Ls) \leq 0.75 \quad (3)$$

where Dg (mm) is a diameter of the large-diameter portion; Lc (mm) is a length of the noble metal tip in an axis direction of the spark plug; and Ls (mm) is a length of the small-diameter portion in the axis direction of the spark plug.

In this configuration, it is possible by satisfaction of the condition (2) to ensure good ignition performance of the spark plug and prevent deterioration in the durability of the center electrode. It is also possible by satisfaction of the condition (3) to, while avoiding the length of the noble metal tip from becoming too small and preventing deterioration in the durability of the noble metal tip, suppress increase in the weight of the front end part of the center electrode constituted by the small-diameter portion and the noble metal tip and improve the breakage resistance of the center electrode even in the case where the diameter Dg of the large-diameter portion is so small as to satisfy the condition (1) such that the center electrode tends to be low in breakage resistance.

[2] According to a second aspect of the present invention, there is provided a spark plug that may satisfy the following condition (4):

$$0.61 \leq Ls/(Lc+Ls) \leq 0.75 \quad (4).$$

It is possible to reduce the weight of the front end part of the center electrode constituted by the small-diameter portion and the noble metal tip and further improve the breakage resistance of the center electrode by satisfaction of the condition (4).

[3] According to a third aspect of the present invention, there is provided a spark plug that may satisfy the following condition (5):

$$Dc \leq Ds \leq Dc+0.4 \quad (5)$$

where Dc (mm) is a diameter of the noble metal tip; and Ds (mm) is a diameter of the small-diameter portion.

It is possible to avoid the diameter Ds of the small-diameter portion from becoming too large and ensure good ignition performance, while ensuring a certain degree of heat conduction from the noble metal tip and preventing wearing of the noble metal tip, by satisfaction of the condition (5).

[4] According to a fourth aspect of the present invention, there is provided a spark plug that may satisfy the following condition (6):

$$1.7 \leq Dg \leq 2.3 \quad (6).$$

It is possible by satisfaction of the condition (6) to, while avoiding the diameter Dg of the large-diameter portion from becoming too small and preventing difficulty in processing and deterioration in durability, improve the breakage resistance of the center electrode even when the diameter Dg of the large-diameter portion is made smaller such that the center electrode tends to be lower in breakage resistance.

[5] According to a fifth aspect of the present invention, there is provided a spark plug that may satisfy the following condition (7):

$$1.7 \leq Dg \leq 1.9 \quad (7).$$

It is possible by satisfaction of the condition (7) to further improve the breakage resistance of the center electrode even when the diameter Dg of the large-diameter portion 21 is made smaller so that the center electrode tends to be lower in breakage resistance.

[6] According to a sixth aspect of the present invention, there is provided a spark plug that may satisfy the following condition (8):

$$0.03 \leq X \leq 0.15 \quad (8)$$

where X (mm) is a clearance between the center electrode and an insulator of the spark plug.

It is possible to further improve the breakage resistance of the center electrode by satisfaction of the condition (8).

[7] According to a seventh aspect of the present invention, there is provided a spark plug, wherein a boundary region between the small-diameter portion and the connection portion of the center electrode may have a rounded profile.

In this case, it is possible to minimize deflection between the small-diameter portion and the connection portion even when an external force is applied to the center electrode.

It is feasible to embody the present invention in any form other than the spark plug. For example, the present invention can be embodied in the form of a center electrode for a spark plug, a method of manufacturing a spark plug or a center electrode for a spark plug etc.

DETAILED DESCRIPTION OF THE PREFERRED EMBODIMENTS

A. Embodiment

A-1. Structure of Spark Plug

Figure 1:
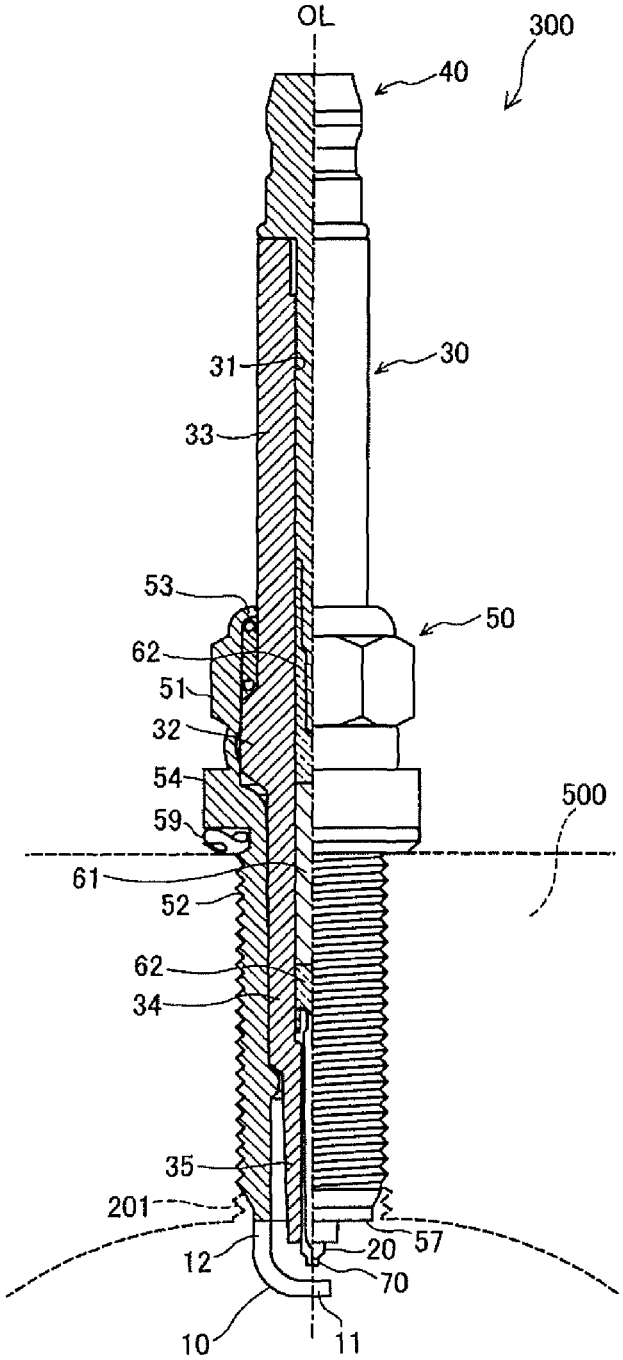
FIG. 1 is a schematic view showing the overall structure of a spark plug 300 according to one exemplary embodiment of the present invention.

FIG. 1 is a schematic view showing the overall structure of a spark plug 300 according to one exemplary embodiment of the present invention. The right and left sides of FIG. 1 with respect to a center axis OL of the spark plug 300 show a side view and a section view of the spark plug 300, respectively. It is herein noted that, in the following explanation, the terms "front" and "rear" respectively refer to the side of location of the after-mentioned ground electrode 10 (i.e. the bottom side of FIG. 1) and the side of location of the after-mentioned metal terminal 40 (i.e. the top side of FIG. 1) with respect to the direction of the axis OL.

The spark plug 300 includes a ceramic insulator 30, a center electrode 20, a metal shell 50, a ground electrode 10 and a metal terminal 40. The center electrode 20 is held in the ceramic insulator 30. The ceramic insulator 30 is held in the metal shell 50. The ground electrode 10 is joined to a front end face 57 of the metal shell 50. The metal terminal 40 is arranged adjacent to a rear end of the center electrode 20.

The ceramic insulator 30 is cylindrical in shape, with an axial hole 30 formed therein in parallel with the axis OL, and is made of a sintered ceramic material such as alumina. The ceramic insulator 30 includes a middle body portion 32, a rear body portion 33, a front body portion 34 and a leg portion 35. The middle body portion 32 is located in the vicinity of the center of the ceramic insulator 30 in the direction of the axis OL and is made larger in diameter than the other portions. The rear body portion 33 is located in rear of the middle body portion 32 and adapted to keep the metal terminal 40 insulated from the metal shell 50. The front body portion 34 is located in front of the middle body portion 32. The leg portion 35 is located in front of the front body portion 34 and is made smaller in outer diameter than the front body portion 34.

The center electrode 20 is made of a metal material in a rod shape and electrically connected to the metal terminal 40 via a ceramic resistor 61 and seal members 62. The center electrode 20 is inserted in the axial hole 31 of the ceramic insulator 30, with a front end part of the center electrode 20 protruding and exposed from the leg portion 35 of the ceramic insulator 30 (as will be explained later in more detail). In the present embodiment, the center electrode 20 has a covering region 25 and a core region 26 embedded in the covering region 25 and having higher thermal conductivity than that of the covering region 25. For example, there can be used a nickel-based alloy containing nickel as a main component as the material of the covering region 25 of the center electrode 20. As the material of the core region 26 of the center electrode 20, there can be used copper or a copper-based alloy containing copper as a main component.

For improvement in spark wear resistance and oxidation resistance, a noble metal tip 70 is joined to a front end of the center electrode 20. The noble metal tip 70 is made of a noble metal or an alloy containing a noble metal as a main component. For example, a Pt—Ir alloy (i.e. an alloy containing Pt as a main component and Ir as an additive element, density: 21 g/cm$^3$) or an Ir—Pt alloy (i.e. an alloy containing Ir as a main component and Pt as an additive component, density: 22 g/cm$^3$) can be used as the material of the noble metal tip 70 in combination of Inconel (INC 600, density: 8.3 g/cm$^3$) as the electrode base material. It is herein noted that the term "main component" refers to a component whose content is the highest in the noble metal tip. It is preferable that the content of the noble metal in the noble metal tip is 50 mass % or more. It is more preferable that a difference between the density of the material of the noble metal tip 70 and the density of the base material of the center electrode 20 is twice or more higher than the density of the base material of the center electrode 20.

The metal shell 50 is substantially cylindrical in shape and adapted to surround and hold a part of the ceramic insulator 30 extending from a front end side of the rear body portion 33 to the leg portion 35. The metal shell 50 is made of a metal material such as low carbon steel. In the present embodiment, the metal shell 50 includes a thread portion 52, a tool engagement portion 51 and a seat portion 54. The thread portion 52 is formed into a substantially cylindrical outer shape on a front end part of the metal shell 50. A thread is cut in a circumferential surface of the thread portion 52 such that, when the spark plug 300 is mounted to an engine head 500, the thread can be screwed into a thread hole 201 of the engine head 500. The tool engagement portion 51 is formed into e.g. a hexagonal cross-section shape such that a tool (not shown) for mounting the spark plug 300 to the engine head 500 can be engaged with the tool engagement portion 51. An annular gasket 59, which is formed by bending a plate material, is disposed between the seat portion 54 and the engine head 500. The metal shell 50 is fixed to the ceramic insulator 30 by crimping a rear end portion 53 of the metal shell 50.

The ground electrode 10 is made of a metal material in a bent rod shape. Although not specifically shown in the drawings, the structure of the ground electrode 10 is similar to that of the center electrode 20. Namely, the ground electrode 10 has a covering region made of e.g. a nickel alloy and a core region made of copper or a copper-based alloy and embedded in the covering region. A base end portion 12 as one end portion of the ground electrode 10 is joined to the front end face 57 of the metal shell 50. The ground electrode 10 is bent such that a free end portion 11 as the other end portion of the ground electrode 10 faces the front end of the center electrode 20. There is a gap for spark discharge (called "discharge gap") defined between the free end portion 11 of the ground electrode 10 and the front end of the center electrode 20. A noble metal tip may be joined to the free end portion 11 of the ground electrode 10 for improvement in spark wear resistance and oxidation resistance.

The metal terminal 40 includes a front end part accommodated in the axial hole 31 of the ceramic insulator 30 and a rear end part protruding and exposed to the outside from the axial hole 31. A high-voltage cable (not shown) is connected to the metal terminal 40 for application of a high voltage.

A-2. Detailed Structure of Center Electrode

Figure 2:
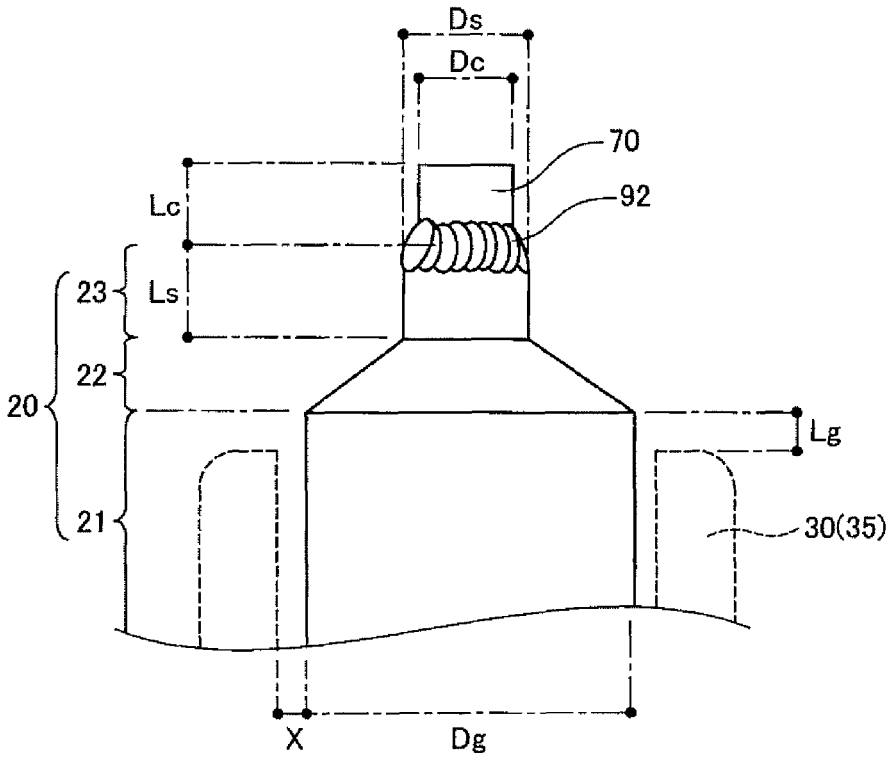
FIG. 2 is a schematic view showing the detained structure of a center electrode 20 according to the one exemplary embodiment of the present invention.
Figure 3:
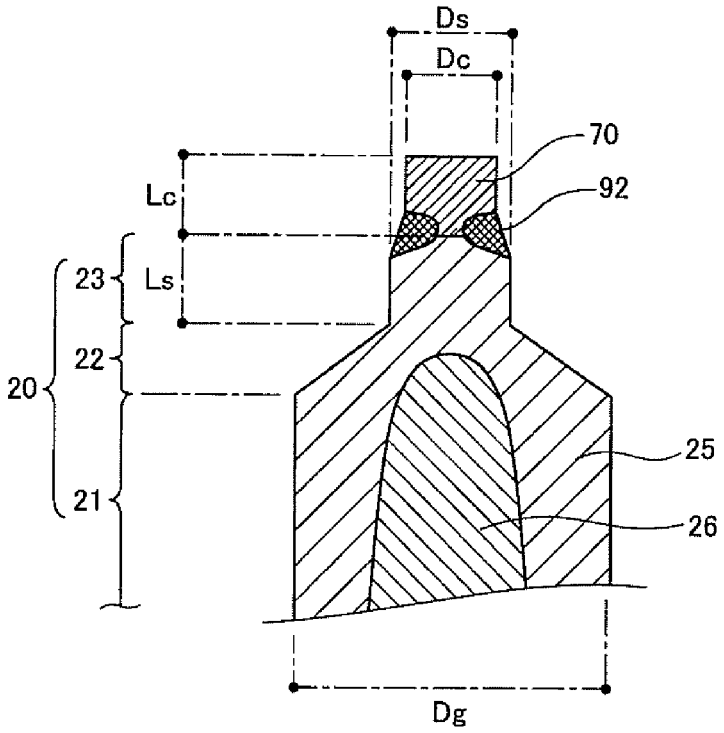
FIG. 3 is a schematic view showing the detained structure of the center electrode 20 according to the one exemplary embodiment of the present invention.
Figure 4:
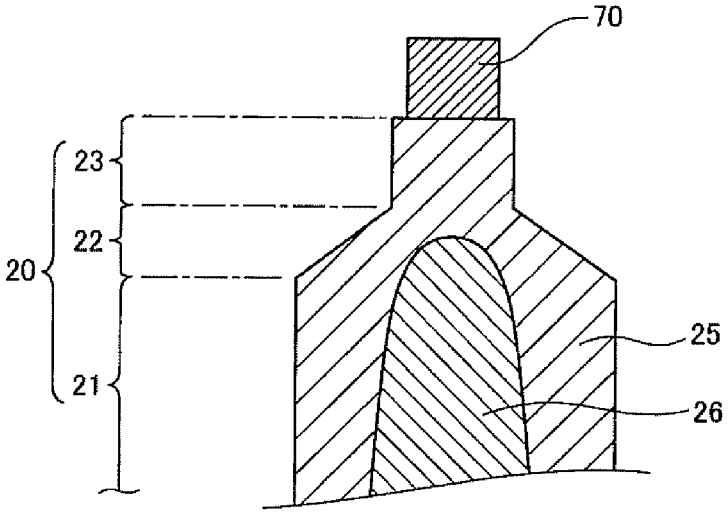
FIG. 4 is a schematic view showing the detained structure of the center electrode 20 according to the one exemplary embodiment of the present invention.

FIGS. 2 to 4 are schematic views showing the detailed structure of the center electrode 20. More specifically, FIG. 2 shows a front side view of the center electrode 20; FIG. 3 shows a front section view of the center electrode 20 taken through the center axis of the spark plug; and FIG. 4 shows a section view of the center electrode 20 and the noble metal tip 70 before laser welding. It is herein noted that: the top side of FIGS. 2 to 3 corresponds to the front side; and the bottom side of FIGS. 2 to 3 corresponds to the rear side.

The center electrode 20 includes a substantially cylindrical column-shaped small-diameter portion 23 having a length of Ls (mm) in the direction of the axis and a diameter of Ds (mm), a substantially cylindrical column-shaped large-diameter portion 21 located in rear of the small-diameter portion 23 and having a diameter of Dg (mm) (where Dg>Ds) and a connection portion 22 connecting the small-diameter portion 23 and the large-diameter portion 23 to each other. The connection portion 22 has a tapered shape such that the diameter of the connection portion 22 gradually changes from the boundary of the connection portion 22 and the small-diameter portion 23 (diameter: Ds) to the boundary of the connection portion 22 and the large-diameter portion 21 (diameter: Dg). As the center electrode 20 is constituted by the small-diameter portion 23, the connection portion 22 and the large-diameter portion 23, the spark plug attains good ignition performance in the present embodiment.

As shown in FIG. 2, the small-diameter portion 23 and the connection portion 22 of the center electrode 20 are located in front of a front end face of the ceramic insulator 30 (leg portion 35). More specifically, the boundary of the connection portion 22 and the large-diameter portion 21 is located in front of the front end face of the ceramic insulator 30. It is preferable to satisfy such a positional relationship between the center electrode 20 and the ceramic insulator 30 for improvement in ignition performance. Even in the case where the boundary of the connection portion 22 and the large-diameter portion 21 is located in rear of the front end face of the ceramic insulator 30, the degree of deterioration in ignition performance is minor as long as the distance from the boundary of the connection portion 22 and the large-diameter portion 21 to the front end face of the ceramic insulator 30 is 2 mm or shorter. Further, the clearance X between the ceramic insulator 30 (as an insulator) and the large-diameter portion 21 of the center electrode 20 is generally set to a value exceeding 0 mm. The preferable value of the clearance X will be explained later.

The noble metal tip 70 is laser welded to the front end of the small-diameter portion 23 of the center electrode 20. The welding of the noble metal tip 70 is done by, while placing the substantially cylindrical column-shaped noble metal tip 70 on the front end face of the small-diameter portion 23, irradiating laser light to a boundary region between the noble metal tip 70 and the small-diameter portion 23. By such welding, the noble metal tip 70 and the center electrode 20 are joined together with the formation of a fused zone 92 on the boundary region.

Figure 5:
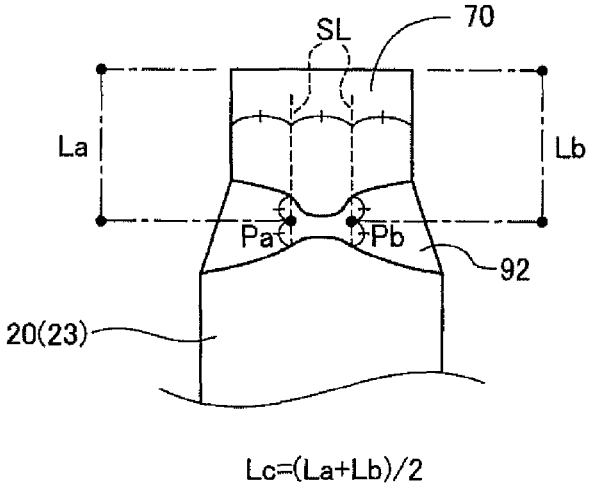
FIG. 5 is a schematic view showing the detained structure of the center electrode 20 according to the one exemplary embodiment of the present invention.

In the case where the noble metal tip 70 and the center electrode 20 are welded to each other in such a manner that the boundary of the noble metal tip 70 and the small-diameter portion 23 before the welding partially remains as shown in FIG. 3, the length Lc of the noble metal tip 70 can be determined by actual measurement. In the case where the fused zone 92 is formed continuously in the radial direction in such a manner that the boundary of the noble metal tip 70 and the small-diameter portion 32 before the welding does not remain as shown in FIG. 5, the length Lc of the noble metal tip 70 can be determined as follows. In a cross section of the center electrode 20 taken through the center axis, there are assumed two straight lines SL that divide the noble metal tip 70 in three equal parts in the radial direction. Midpoints Pa and Pb of parts (line segments) of the respective straight lines SL overlapping the fused zone 92 are determined. An average value of distances La and Lb from the front end face of the noble metal tip 70 to the midpoints Pa and Pb ((La+Lb)/2) in the axis direction is calculated as the length Lc of the noble metal tip 70. The length Ls of the small-diameter portion 23 can be determined upon determination of the length Lc of the noble metal tip 70.

A-3. Performance Evaluation Tests

The spark plug 300 according to the present invention was tested for the ignition performance, the durability of the noble metal tip 70 and the breakage resistance of the center electrode 20 by the following performance evaluation tests.

A-3-1. Evaluation Test on Ignition Performance

TABLE 1 shows the results of evaluation test on the ignition performance of the spark plug 300. In the ignition performance evaluation test, a plurality of samples (Sample No. 1 to 5) of the spark plug were prepared by varying the length Ls of the small-diameter portion 23 of the center electrode 20. Then, the misfire limit air/fuel ratio of the respective samples was examined. The higher the misfire limit air-fuel ratio, the better the ignition performance of the spark plug 300. The detailed test conditions were as follows: test method: misfire test method; engine used: in-line four-cylinder DOHC natural aspiration type engine with a displacement: 1.6 liter; operating conditions: revolution speed: 1600 rpm; dimensions of noble metal tip 70: diameter Dc: 0.6 mm, length Lc: 0.5 mm; dimensions of small-diameter portion 23: diameter Ds: 0.9 mm, length Ls: 0.6 to 0.8 mm (varied from sample to sample); and dimensions of large-diameter portion 21: diameter Dg: 2.6 mm.

TABLE 1

| Dc = 0.6 mm, Ds = 0.9 mm | | | | | |
|---|---|---|---|---|---|
| Sample No. | 1 | 2 | 3 | 4 | 5 |
| Lc (mm) | 0.5 | 0.5 | 0.5 | 0.5 | 0.5 |
| Ls (mm) | 0.6 | 0.65 | 0.7 | 0.75 | 0.8 |
| Lc + Ls (mm) | 1.1 | 1.15 | 1.2 | 1.25 | 1.3 |
| Misfire limit air/fuel ratio | 18.5 | 19.0 | 19.0 | 19.1 | 19.1 |

The samples of No. 2 to 5, where the sum (Ls+Lc) of the length Ls of the small-diameter portion 23 and the length Lc of the noble metal tip 70 was set larger than or equal to 1.15, had a misfire limit air/fuel ratio of 19 or higher and showed good ignition performance. The sample of No. 1, where the sum (Ls+Lc) was set smaller than 1.15, had a misfire limit air/fuel ratio of lower than 19 and did not show good ignition performance. Although the sum (Ls+Lc) was changed by varying the length Ls of the small-diameter portion 23 in this evaluation test, it is assumed that the same test results would be obtained even when the sum (Ls+Lc) was changed by varying the length Lc of the noble metal tip 70. In other words, it is assumed that the ignition performance of the spark plug 300 depends on the sum of the length Ls of the small-diameter portion 23 and the length Lc of the noble metal tip 70, rather than the individual lengths Ls and Lc of the small-diameter portion 23 and the noble metal tip 70. It is thus preferable that, in order for the spark plug 300 to ensure good ignition performance, the center electrode 20 of the spark plug 300 satisfies the following relationship: $Lc+Ls \geq 1.15$.

If the sum of the length Ls of the small-diameter portion 23 and the length Lc of the noble metal tip 70 is too large, however, there may arise a problem of deterioration in the durability of the center electrode 20 due to overheating in the engine. It is thus more preferable that the center electrode 20 satisfies the following relationship: $1.15 \leq Lc+Ls \leq 3.0$ for good ignition performance and high durability.

For better ignition performance and higher durability, it is still more preferable that the center electrode 20 satisfies the following relationship: $1.15 \leq Lc+Ls \leq 2.0$.

A-3-2. Evaluation Test on Durability.

Figure 6:
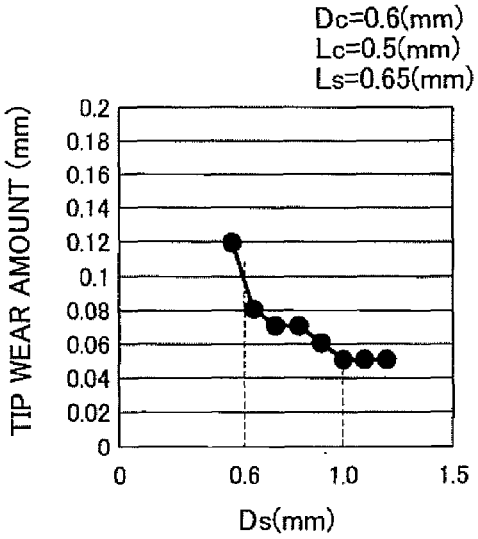
FIG. 6 is a schematic diagram showing the results of evaluation test on the durability of the spark plug 300.

FIG. 6 shows the results of evaluation test on the durability of the spark plug 300. The smaller the diameter Ds of the small-diameter portion 23 of the center electrode 20, the lower the heat conduction from the noble metal tip, the larger the amount of wear of the noble metal tip 70. In the durability evaluation test, the relationship of the diameter Ds of the small-diameter portion 23 of the center electrode 20 and the amount of wear of the noble metal tip 70 was examined. The detailed test conditions were as follows: test method: full-throttle durability test method; engine used: in-line four-cylinder DOHC natural aspiration type engine with a displacement: 1.6 liter; operating conditions: revolution speed: 5000 rpm, W.O.T.: 100-hour operation; temperature of large-diameter portion 21: 800° C., dimensions of noble metal tip 70 (Ir—Pt alloy): diameter Dc: 0.6 mm, length Lc: 0.5 mm; dimensions of small-diameter portion 23: diameter Ds: 0.5 to 1.2 mm (varied from sample to sample), and length Ls: 0.65 mm.

As shown in FIG. 6, the amount of wear of the noble metal tip 70 was decreased with increase in the heat conduction from the noble metal tip 70 as the diameter Ds of the small-diameter portion 23 became larger. More specifically, the amount of wear of the noble metal tip 70 was favorably less than 0.1 mm when the diameter Ds of the small-diameter portion 23 was larger than or equal to 0.6 mm (i.e. larger than or equal to the diameter Dc of the noble metal tip 70). The amount of wear of the noble metal tip 70 leveled off, regardless of the increase of the diameter Ds, when the diameter Ds of the small-diameter portion 23 was larger than or equal to 1.0 mm (i.e. larger than the diameter Dc of the noble metal tip 70 by an amount of 0.4 mm or more). The reason for this is assumed that, when the difference between the diameter Ds of the small-diameter portion 23 and the diameter Dc of the noble metal tip 70 was larger than or equal to a certain degree, the increase of the diameter Ds had almost no contribution to the heat conduction from the noble metal tip 70. It is thus preferable that the center electrode 20 satisfies the following relationship: $Dc \leq Ds \leq Dc+0.4$ in order to secure good ignition performance of the spark plug 300 and prevent wearing of the noble metal tip 70.

A-3-3. First Evaluation Test on Breakage Resistance of Center Electrode 20

TABLES 2 to 9 show the result of first evaluation test on the breakage resistance of the center electrode 20. In the first breakage resistance evaluation test, a plurality of samples were prepared by changing the ratio (Ls/(Lc+Ls)) of the length Ls of the small-diameter portion 23 to the sum (Lc+Ls) of the length Ls of the small-diameter portion 23 and the length Lc of the noble metal tip 70 (referred to as "small-diameter portion's occupying ratio"). Then, the breakage resistance of the respective samples was examined. In the samples, the small-diameter portion's occupying ratio was changed by varying the length Ls of the small-diameter portion 23 and the length Lc of the noble metal tip 70 while fixing the sum (Lc+Ls) at 1.15 mm (see TABLES 2 to 5) or 1.2 mm (see TABLES 6 to 9).

The small-diameter portion's occupying ratio (Ls/(Lc+Ls)) refers to the ratio of the length Ls of the small-diameter portion 23 to the overall length of the part of the center electrode 20 constituted by the small-diameter portion 23 and the noble metal tip 70. Herein, the noble metal tip 70 is made of a material high in density. Under the condition that the sum (Lc+Ls) is the same, the weight of the part constituted by the small-diameter portion 23 and the noble metal tip 70 decreases with increase in the small-diameter portion's occupying ratio (Ls/(Lc+Ls)). Thus, the higher the small-diameter portion's occupying ratio (Ls/(Lc+Ls)), the higher the breakage resistance of the center electrode 20. The detailed test conditions were as follows: test method: ultrasonic vibration test method, vibration direction: radial direction of center electrode 20, vibration frequency: 27.3 kHz; evaluation criteria; occurrence or non-occurrence of breakage of center electrode 20 during application of vibration for 180 seconds (○: non-occurrence of breakage, x: occurrence of breakage); dimensions of noble metal tip 70: diameter Dc: 0.4 to 1.0 mm (varied from sample to sample), length Lc: 0.3 to 0.8 mm (varied from sample to sample); dimensions of small-diameter portion 23: diameter Ds: 0.7 to 1.3 mm (varied from sample to sample), length Ls: 0.35 to 0.85 mm (varied from sample to sample); dimensions of large-diameter portion 21: diameter Dg: 2.6 mm; and dimensions of fused zone 92: length of fused zone 92 in the axis direction: 0.4 mm.

TABLE 2

Dc = 0.4 mm, Ds = 0.7 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 11 | 0.8 | 0.35 | 1.15 | 0.30 | x |
| 12 | 0.7 | 0.45 | 1.15 | 0.39 | x |
| 13 | 0.6 | 0.55 | 1.15 | 0.48 | ○ |
| 14 | 0.5 | 0.65 | 1.15 | 0.57 | ○ |
| 15 | 0.4 | 0.75 | 1.15 | 0.65 | ○ |
| 16 | 0.3 | 0.85 | 1.15 | 0.74 | ○ |

TABLE 3

Dc = 0.6 mm, Ds = 0.9 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 21 | 0.8 | 0.35 | 1.15 | 0.30 | x |
| 22 | 0.7 | 0.45 | 1.15 | 0.39 | x |
| 23 | 0.6 | 0.55 | 1.15 | 0.48 | ○ |
| 24 | 0.5 | 0.65 | 1.15 | 0.57 | ○ |
| 25 | 0.4 | 0.75 | 1.15 | 0.65 | ○ |
| 26 | 0.3 | 0.85 | 1.15 | 0.74 | ○ |

TABLE 4

Dc = 0.8 mm, Ds = 1.1 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 31 | 0.8 | 0.35 | 1.15 | 0.30 | x |
| 32 | 0.7 | 0.45 | 1.15 | 0.39 | x |
| 33 | 0.6 | 0.55 | 1.15 | 0.48 | ○ |
| 34 | 0.5 | 0.65 | 1.15 | 0.57 | ○ |
| 35 | 0.4 | 0.75 | 1.15 | 0.65 | ○ |
| 36 | 0.3 | 0.85 | 1.15 | 0.74 | ○ |

TABLE 5

Dc = 1.0 mm, Ds = 1.3 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 41 | 0.8 | 0.35 | 1.15 | 0.30 | x |
| 42 | 0.7 | 0.45 | 1.15 | 0.39 | x |
| 43 | 0.6 | 0.55 | 1.15 | 0.48 | ○ |
| 44 | 0.5 | 0.65 | 1.15 | 0.57 | ○ |
| 45 | 0.4 | 0.75 | 1.15 | 0.65 | ○ |
| 46 | 0.3 | 0.85 | 1.15 | 0.74 | ○ |

TABLE 6

Dc = 0.4 mm, Ds = 0.7 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 51 | 0.8 | 0.4 | 1.2 | 0.33 | x |
| 52 | 0.7 | 0.5 | 1.2 | 0.42 | x |
| 53 | 0.6 | 0.6 | 1.2 | 0.50 | ○ |
| 54 | 0.5 | 0.7 | 1.2 | 0.58 | ○ |
| 55 | 0.4 | 0.8 | 1.2 | 0.67 | ○ |
| 56 | 0.3 | 0.9 | 1.2 | 0.75 | ○ |

TABLE 7

Dc = 0.6 mm, Ds = 0.9 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 61 | 0.8 | 0.4 | 1.2 | 0.33 | x |
| 62 | 0.7 | 0.5 | 1.2 | 0.42 | x |
| 63 | 0.6 | 0.6 | 1.2 | 0.50 | ○ |
| 64 | 0.5 | 0.7 | 1.2 | 0.58 | ○ |
| 65 | 0.4 | 0.8 | 1.2 | 0.67 | ○ |
| 66 | 0.3 | 0.9 | 1.2 | 0.75 | ○ |

TABLE 8

Dc = 0.8 mm, Ds = 1.1 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 71 | 0.8 | 0.4 | 1.2 | 0.33 | x |
| 72 | 0.7 | 0.5 | 1.2 | 0.42 | x |
| 73 | 0.6 | 0.6 | 1.2 | 0.50 | ○ |
| 74 | 0.5 | 0.7 | 1.2 | 0.58 | ○ |
| 75 | 0.4 | 0.8 | 1.2 | 0.67 | ○ |
| 76 | 0.3 | 0.9 | 1.2 | 0.75 | ○ |

TABLE 9

Dc = 1.0 mm, Ds = 1.3 mm

| Sample No. | Lc (mm) | Ls (mm) | Lc + Ls (mm) | Ls/(Lc + Ls) | Breakage in 180 sec. ○: not occurred x: occurred |
|---|---|---|---|---|---|
| 81 | 0.8 | 0.4 | 1.2 | 0.33 | x |
| 82 | 0.7 | 0.5 | 1.2 | 0.42 | x |
| 83 | 0.6 | 0.6 | 1.2 | 0.50 | ○ |

TABLE 9-continued

| Dc = 1.0 mm, Ds = 1.3 mm | | | | | |
|---|---|---|---|---|---|
| Sample No. | Lc (mm) | Ls (mm) | Lc + Ls (mm) | Ls/(Lc + Ls) | Breakage in 180 sec. ○: not occurred x: occurred |
| 84 | 0.5 | 0.7 | 1.2 | 0.58 | ○ |
| 85 | 0.4 | 0.8 | 1.2 | 0.67 | ○ |
| 86 | 0.3 | 0.9 | 1.2 | 0.75 | ○ |

TABLES 2 to 5 show the result of the breakage resistance evaluation test where the sum (Lc+Ls) of the length Ls of the small-diameter portion 23 and the length Lc of the noble metal tip 70 was set to 1.15 mm. TABLES 6 to 9 show the result of the breakage resistance evaluation test where the sum (Lc+Ls) was set to 1.2 mm. In the samples of TABLES 2 to 5, the diameter Dc of the noble metal tip 70 and the diameter Ds of the small-diameter portion 23 were set to different values. In the samples of TABLES 6 to 9, the diameter Dc of the noble metal tip 70 and the diameter Ds of the small-diameter portion 23 were set to different values.

In the samples where the small-diameter portion's occupying ratio (Ls/(Lc+Ls)) was set lower than 0.48 (i.e. samples of No. 11, 12, 21, 22, 31, 32, 41, 42, 51, 52, 61, 62, 71, 72, 81 and 82), there occurred breakage of the center electrode 20 during the application of vibration for 180 seconds regardless of the value of the diameter Dc of the noble metal tip 70 and the value of the diameter Ds of the small-diameter portion 23. Herein, the breakage occurred in the vicinity of the boundary of the small-diameter portion 23 and the connection portion 22. In the samples where the small-diameter portion's occupying ratio (Ls/(Lc+Ls)) was set higher than or equal to 0.48 (i.e. samples other than above), on the other hand, there did not occur breakage of the center electrode 20 during the application of vibration for 180 seconds regardless of the value of the diameter Dc and the value of the diameter Ds. It is thus preferable that, in order to improve the breakage resistance of the center electrode 20, the center electrode 20 satisfies the following relationship: $Ls/(Lc+Ls) \geq 0.48$.

If the small-diameter portion's occupying ratio (Ls/(Lc+Ls)) is too high, however, the length Lc of the noble metal tip 70 becomes small so that there may arise a problem of deterioration in the durability of the noble metal tip 70. It is thus more preferable that the center electrode 20 satisfies the following relationship: $0.48 \leq Ls/(Lc+Ls) \leq 0.75$ for improvements in the breakage resistance of the center electrode 20 and the durability of the noble metal tip 70.

A-3-4. Second Evaluation Test on Breakage Resistance of Center Electrode 20

TABLES 10 to 17 show the result of second evaluation test on the breakage resistance of the center electrode 20. The second breakage resistance evaluation test was performed in the same manner as in the first breakage resistance evaluation test except that the time of application of vibration was changed from 180 seconds to 300 seconds. The other test method and conditions of the second breakage resistance evaluation test were the same as those of the first breakage resistance evaluation test.

TABLE 10

| Dc = 0.4 mm, Ds = 0.7 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 91 | 0.6 | 0.55 | 1.15 | 0.48 | x |
| 92 | 0.55 | 0.6 | 1.15 | 0.52 | x |
| 93 | 0.5 | 0.65 | 1.15 | 0.57 | x |
| 94 | 0.45 | 0.7 | 1.15 | 0.61 | ○ |
| 95 | 0.4 | 0.75 | 1.15 | 0.65 | ○ |
| 96 | 0.35 | 0.8 | 1.15 | 0.70 | ○ |
| 97 | 0.3 | 0.85 | 1.15 | 0.74 | ○ |

TABLE 11

| Dc = 0.6 mm, Ds = 0.9 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 101 | 0.6 | 0.55 | 1.15 | 0.48 | x |
| 102 | 0.55 | 0.6 | 1.15 | 0.52 | x |
| 103 | 0.5 | 0.65 | 1.15 | 0.57 | x |
| 104 | 0.45 | 0.7 | 1.15 | 0.61 | ○ |
| 105 | 0.4 | 0.75 | 1.15 | 0.65 | ○ |
| 106 | 0.35 | 0.8 | 1.15 | 0.70 | ○ |
| 107 | 0.3 | 0.85 | 1.15 | 0.74 | ○ |

TABLE 12

| Dc = 0.8 mm, Ds = 1.1 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 111 | 0.6 | 0.55 | 1.15 | 0.48 | x |
| 112 | 0.55 | 0.6 | 1.15 | 0.52 | x |
| 113 | 0.5 | 0.65 | 1.15 | 0.57 | x |
| 114 | 0.45 | 0.7 | 1.15 | 0.61 | ○ |
| 115 | 0.4 | 0.75 | 1.15 | 0.65 | ○ |
| 116 | 0.35 | 0.8 | 1.15 | 0.70 | ○ |
| 117 | 0.3 | 0.85 | 1.15 | 0.74 | ○ |

TABLE 13

| Dc = 1.0 mm, Ds = 1.3 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 121 | 0.6 | 0.55 | 1.15 | 0.48 | x |
| 122 | 0.55 | 0.6 | 1.15 | 0.52 | x |
| 123 | 0.5 | 0.65 | 1.15 | 0.57 | x |
| 124 | 0.45 | 0.7 | 1.15 | 0.61 | ○ |
| 125 | 0.4 | 0.75 | 1.15 | 0.65 | ○ |
| 126 | 0.35 | 0.8 | 1.15 | 0.70 | ○ |
| 127 | 0.3 | 0.85 | 1.15 | 0.74 | ○ |

TABLE 14

| Dc = 0.4 mm, Ds = 0.7 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 131 | 0.6 | 0.6 | 1.2 | 0.50 | x |
| 132 | 0.55 | 0.65 | 1.2 | 0.54 | x |
| 133 | 0.5 | 0.7 | 1.2 | 0.58 | x |
| 134 | 0.45 | 0.75 | 1.2 | 0.63 | ○ |
| 135 | 0.4 | 0.8 | 1.2 | 0.67 | ○ |
| 136 | 0.35 | 0.85 | 1.2 | 0.71 | ○ |
| 137 | 0.3 | 0.9 | 1.2 | 0.75 | ○ |

TABLE 15

| Dc = 0.6 mm, Ds = 0.9 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 141 | 0.6 | 0.6 | 1.2 | 0.50 | x |
| 142 | 0.55 | 0.65 | 1.2 | 0.54 | x |
| 143 | 0.5 | 0.7 | 1.2 | 0.58 | x |
| 144 | 0.45 | 0.75 | 1.2 | 0.63 | ○ |
| 145 | 0.4 | 0.8 | 1.2 | 0.67 | ○ |
| 146 | 0.35 | 0.85 | 1.2 | 0.71 | ○ |
| 147 | 0.3 | 0.9 | 1.2 | 0.75 | ○ |

TABLE 16

| Dc = 0.8 mm, Ds = 1.1 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 151 | 0.6 | 0.6 | 1.2 | 0.50 | x |
| 152 | 0.55 | 0.65 | 1.2 | 0.54 | x |
| 153 | 0.5 | 0.7 | 1.2 | 0.58 | x |
| 154 | 0.45 | 0.75 | 1.2 | 0.63 | ○ |
| 155 | 0.4 | 0.8 | 1.2 | 0.67 | ○ |
| 156 | 0.35 | 0.85 | 1.2 | 0.71 | ○ |
| 157 | 0.3 | 0.9 | 1.2 | 0.75 | ○ |

TABLE 17

| Dc = 1.0 mm, Ds = 1.3 mm | | | | | |
|---|---|---|---|---|---|
| Sample No. | Lc (mm) | Ls (mm) | Lc + Ls (mm) | Ls/(Lc + Ls) | Breakage in 300 sec. ○: not occurred x: occurred |
| 161 | 0.6 | 0.6 | 1.2 | 0.50 | x |
| 162 | 0.55 | 0.65 | 1.2 | 0.54 | x |
| 163 | 0.5 | 0.7 | 1.2 | 0.58 | x |
| 164 | 0.45 | 0.75 | 1.2 | 0.63 | ○ |
| 165 | 0.4 | 0.8 | 1.2 | 0.67 | ○ |
| 166 | 0.35 | 0.85 | 1.2 | 0.71 | ○ |
| 167 | 0.3 | 0.9 | 1.2 | 0.75 | ○ |

TABLES 10 to 13 show the result of the breakage resistance evaluation test where the sum (Lc+Ls) of the length Ls of the small-diameter portion 23 and the length Lc of the noble metal tip 70 was set to 1.15 mm. TABLES 14 to 17 show the result of the breakage resistance evaluation test where the sum (Lc+Ls) was set to 1.2 mm. In the samples of TABLES 10 to 13, the diameter Dc of the noble metal tip 70 and the diameter Ds of the small-diameter portion 23 were set to different values. In the samples of TABLES 14 to 17, the diameter Dc of the noble metal tip 70 and the diameter Ds of the small-diameter portion 23 were set to different values.

In the samples where the small-diameter portion's occupying ratio (Ls/(Lc+Ls)) was set lower than 0.61 (i.e. samples of No. 91, 92, 93, 101, 102, 103, 111, 112, 113, 121, 122, 123, 131, 132, 133, 141, 142, 143, 151, 152, 153, 161, 162 and 163), there occurred breakage of the center electrode 20 during the application of vibration for 300 seconds regardless of the value of the diameter Dc of the noble metal tip 70 and the value of the diameter Ds of the small-diameter portion 23. In the samples where the small-diameter portion's occupying ratio (Ls/(Lc+Ls)) was set higher than or equal to 0.61 (i.e. samples other than above), on the other hand, there did not occur breakage of the center electrode 20 during the application of vibration for 300 seconds regardless of the value of the diameter Dc and the value of the diameter Ds. It is thus still more preferable that the center electrode 20 satisfies the following relationship: $0.61 \leq Ls/(Lc+Ls) \leq 0.75$ for further improvements in the breakage resistance of the center electrode 20 and the durability of the noble metal tip 70.

A-3-5. Third Evaluation Test on Breakage Resistance of Center Electrode 20

Figure 7:
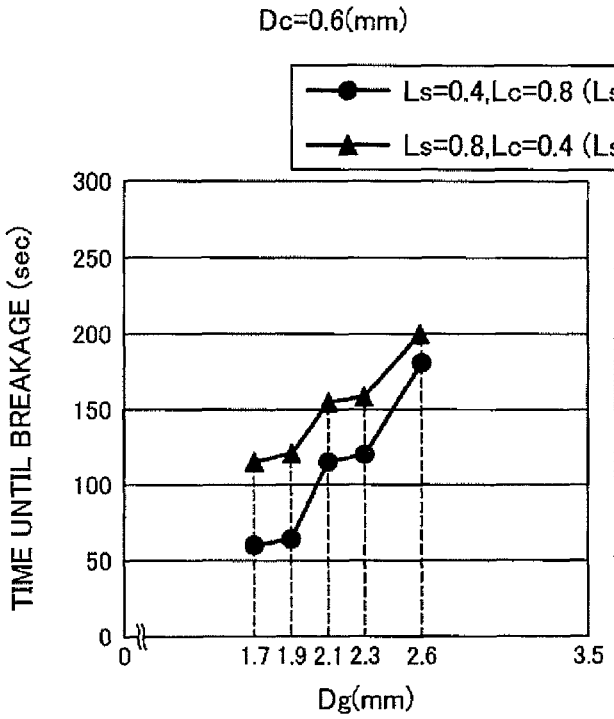
FIG. 7 is a schematic diagram showing the results of third evaluation test on the breakage resistance of the center electrode 20.

FIG. 7 shows the result of third evaluation test on the breakage resistance of the center electrode 20. The breakage resistance of the center electrode 20 also depends on the diameter Dg of the large-diameter portion 21. In general, the smaller the diameter Dg of the large-diameter portion 21, the larger the vibration of the center electrode 20, the higher the risk of breakage of the center electrode 20. In the third breakage resistance evaluation test, a plurality of samples were prepared by varying the diameter Dg of the large-diameter portion 21. The breakage resistance of the respective samples was examined. More specifically, each of the samples was subjected to burner heating/cooling test operation (repeated 1000 cycles of heating (temperature: 900 degrees Celsius) for 2 minutes and cooling for 1 minute), and then, tested by the same ultrasonic vibration test method as in the first and second breakage resistance evaluation tests except that the application of vibration was continued until the occurrence of breakage of the center electrode 20. The detailed test conditions were as follows: dimensions of noble metal tip 70: diameter Dc: 0.6 mm, length Lc: 0.8 mm or 0.4 mm (varied from sample to sample); dimensions of small-diameter portion 23: diameter Ds: 0.9 mm, length Ls: 0.4 mm or 0.8 mm (varied from sample to sample); and dimensions of large-diameter portion 21: diameter Dg: 1.7 to 2.6 mm (varied from sample to sample).

As shown in FIG. 7, there was a general tendency that the time elapsed until the breakage of the center electrode 20 was decreased (i.e. the breakage resistance of the center electrode was deteriorated) as the diameter Dg of the large-diameter portion 21 became smaller. Focusing the small-diameter portion's occupying ratio (Ls/(Lc+Ls)), the time elapsed until the breakage of the center electrode 20 was longer (i.e. the breakage resistance of the center electrode was higher) in the samples where the small-diameter portion's occupying ratio (Ls/(Lc+Ls)) was set to 0.67 (as indicated by triangle plots in FIG. 7) than in the samples where the small-diameter portion's occupying ratio was set to 0.33 (as indicated by circle plots in FIG. 7).

Herein, the rate of improvement of the breakage resistance by increase of the small-diameter portion's occupying ratio from 0.33 to 0.67 was determined based on comparison of the samples where the diameter Dg of the large-diameter portion 21 was the same. This breakage resistance improvement rate was defined as a ratio of the time elapsed until the breakage of the center electrode in the sample where the small-diameter portion's occupying ratio (Ls/(Lc+Ls)) was set to 0.33 to the time elapsed until the breakage of the center electrode in the sample where the small-diameter portion's occupying ratio was set to 0.67. As shown in FIG. 7, the breakage resistance improvement rate was increased with decrease in the diameter Dg of the large-diameter portion 21. More specifically, the breakage resistance improvement rate was 1.1 or higher (i.e. the breakage resistance was improved by 10% or more) when the diameter Dg of the large-diameter portion 21 was set smaller than or equal to 2.6 mm. It can be thus said that it is possible to obtain a great breakage resistance improvement effect by increase of the small-diameter portion's occupying ratio (Ls/(Lc+Ls)) in the case where the center electrode 20 satisfies the following relationship: Dg≤2.6.

When the diameter Dg of the large-diameter portion 21 was set smaller than or equal to 2.3 mm, the breakage resistance improvement rate was 1.3 or higher (i.e. the breakage resistance was improved by 30% or more). It can be thus said that it is possible to obtain a greater breakage resistance improvement effect by increase of the small-diameter portion's occupying ratio (Ls/(Lc+Ls)) in the case where the center electrode 20 satisfies the following relationship: Dg≤2.3.

If the diameter Dg of the large-diameter portion 21 is too small, however, there may arise a problem of difficulty in processing and deterioration in durability. It is thus more preferable that the center electrode 20 satisfies the following relationship: 1.7≤Dg≤2.3 for improvements in the breakage resistance of the center electrode 20 and the ease of processing and durability of the large-diameter portion 21.

As shown in FIG. 7, the breakage resistance improvement rate was 1.8 or higher (i.e. the breakage resistance was improved by 80% or more) when the diameter Dg of the large-diameter portion 21 was set smaller than or equal to 1.9 mm. It can be thus said that it is possible to obtain a still greater breakage resistance improvement effect by increase of the small-diameter portion's occupying ratio (Ls/(Lc+Ls)) in the case where the center electrode 20 satisfies the following relationship: 1.7≤Dg≤1.9.

A-3-6. Fourth Evaluation Test on Breakage Resistance of Center Electrode 20

Figure 8:
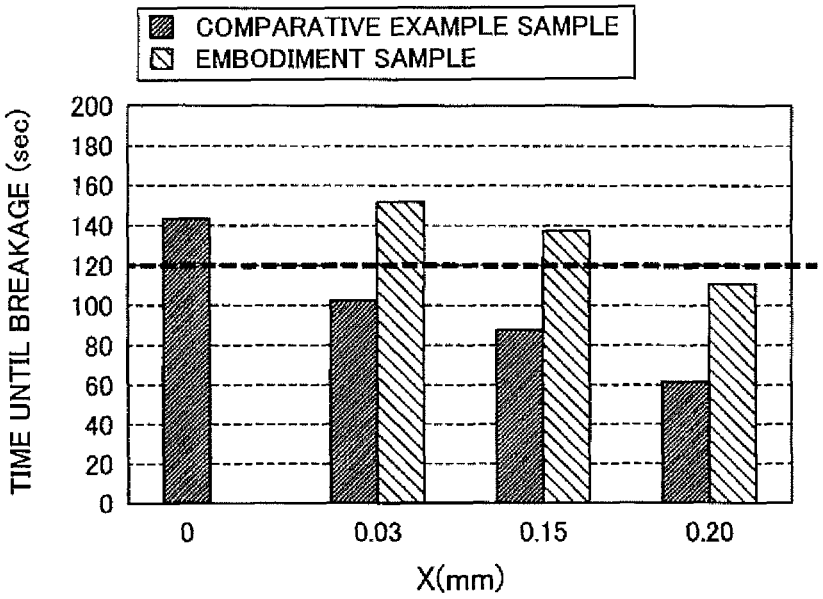
FIG. 8 is a schematic diagram showing results of fourth evaluation test result on the breakage resistance of the center electrode 20.

FIG. 8 shows the result of fourth evaluation test on the breakage resistance of the center electrode 20. The breakage resistance of the center electrode 20 also depends on the size of the clearance X between the center electrode 20 and the ceramic insulator 30 (see FIG. 2). In general, the larger the size of the clearance X, the larger the vibration of the center electrode 20, the higher the risk of breakage of the center electrode 20. In the fourth breakage resistance evaluation test, two types of samples (comparative example samples and embodiment samples) were prepared by varying the size of the clearance X. Although each of the samples used in the third breakage resistance evaluation test was the center electrode 20 without the ceramic insulator 30, each of the samples used in the fourth breakage resistance evaluation test was the center electrode 20 with the ceramic insulator 30 fitted therearound. The other test conditions of the fourth breakage resistance evaluation test were the same as those of the third breakage resistance evaluation test except for the shapes of the samples. The shape of the comparative example sample was as follows: dimensions of noble metal tip 70: diameter Dc: 0.6 mm, length Lc: 0.8 mm; dimensions of small-diameter portion 23: diameter Ds: 0.9 mm, length Ls: 0.4 mm; and dimensions of large-diameter portion 21: diameter Dg: 1.9 mm. The shape of the embodiment sample was as follows: dimensions of noble metal tip 70: diameter Dc: 0.6 mm, length Lc: 0.4 mm; dimensions of small-diameter portion 23: diameter Ds: 0.9 mm, length Ls: 0.8 mm; and dimensions of large-diameter portion 21: diameter Dg: 1.9 mm. The dimensions of the embodiment sample of FIG. 8 correspond to those of the sample of Dg=1.9 mm as indicated by black triangle plot in FIG. 7.

As shown in FIG. 8, there was a general tendency that the time elapsed until the breakage of the center electrode 20 was decreased (i.e. the breakage resistance of the center electrode was deteriorated) as the size of the clearance X became larger. Although the test was not performed on the embodiment sample where the clearance X was set to zero, it is assumed from the tendency of the test results of the comparative example samples that the time elapsed until the occurrence of breakage of the center electrode in the embodiment sample where the clearance X was set to zero would be longer than that in the embodiment sample where the clearance X was set to 0.03 mm. The time elapsed until the occurrence of breakage of the center electrode was 138 seconds or longer in the embodiment samples where the clearance X was set to 0.03 to 0.15 mm. These embodiment samples showed higher breakage resistance than that of the sample indicated by black triangle plot (Dg=1.9 mm) in FIG. 7. The time elapsed until the occurrence of breakage of the center electrode was 112 seconds in the embodiment sample where the clearance X was set to 0.20 mm. This embodiment sample showed breakage resistance equivalent to that of the sample indicated by black triangle plot (Dg=1.9 mm) in FIG. 7. For improvement in the breakage resistance of the center electrode by size control of the clearance X, the clearance X is preferably set to be smaller than or equal to 0.15 mm. Further, the clearance X is preferably set to be larger than 0 mm in view of thermal expansion of the center electrode 20. It is thus preferable that, in order to further improve the breakage resistance of the center electrode 20, the center electrode 20 satisfies the following relationship: 0.03≤X≤0.15.

A-4. Others

Figure 9:
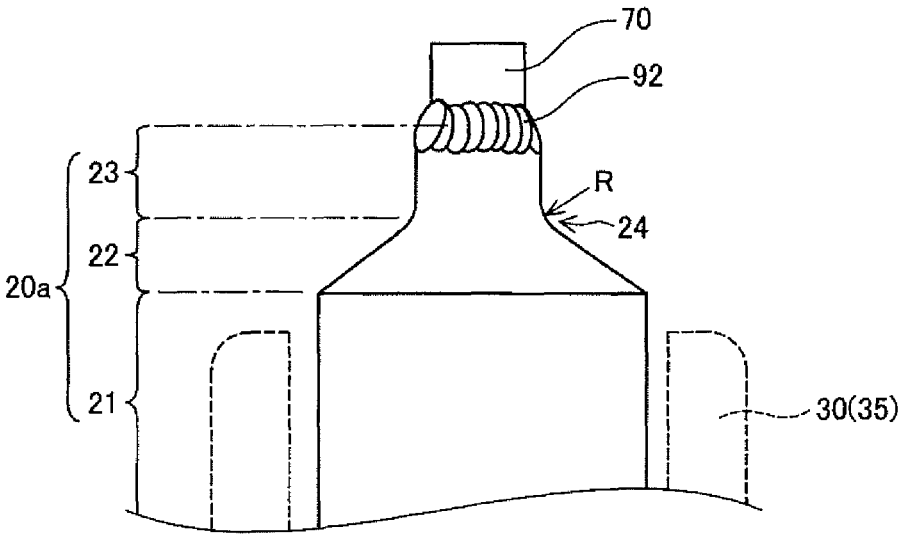
FIG. 9 is a schematic view showing a preferred example of the outline shape of a boundary region between a small-diameter portion and a connection portion of the center electrode.

FIG. 9 is a schematic view showing a preferred example of the outline shape of the boundary region between the small-diameter portion 23 and the connection portion 22 of the center electrode 20. As will be understood from comparison of FIG. 2 and FIG. 9, the boundary region 24 between the small-diameter portion 23 and the connection portion 22 is formed with a curvature radius R (i.e., rounded in shape). In other words, the profile of the boundary region 24 is rounded such that the boundary of the small-diameter portion 23 and the connection portion 22 is unclear and, when viewed in plan, is gently curved in the spark plug of FIG. 9. In the spark plug of FIG. 2, by contrast, the boundary of the small-diameter portion 23 and the connection portion 22 is clear and is formed in such a geometrical shape that two straight lines intersect at one point when viewed in plan. In the spark plug of FIG. 9, it is preferable that the entire profile of the boundary region 24 is formed in a rounded shape. Further, the curvature radius R of this rounded shape is preferably 0.1 mm to 0.5 mm. By the formation of such a rounded boundary region 24, it is possible to minimize deflection between the small-diameter portion 23 and the connection portion 22 even when an external force is applied to the center electrode 20.

As described above, the center electrode 20 of the spark plug 300 according to the present embodiment has the small-diameter portion 23 with the noble metal tip 70 joined by laser welding to the front end of the small-diameter portion 23, the large-diameter portion 21 made larger in diameter than the small-diameter portion 23 and the connection portion 22 connecting the small-diameter portion 23 and the large-diameter portion 21 to each other. In the above-configured spark plug 300, the following conditions (1) to (3) are satisfied. By satisfaction of the condition (2), it is possible to ensure good ignition performance of the spark plug 300 and prevent deterioration in the durability of the center electrode 20. It is also possible by satisfaction of the condition (3) to, while avoiding the length of the noble metal tip 70 from becoming too small and preventing deterioration in the durability of the noble metal tip 70, suppress increase in the weight of the front end part of the center electrode 20 constituted by the noble metal tip 70 and the small-diameter portion 23 and improve the breakage resistance of the center electrode 20 even in the case where the diameter Dg of the large-diameter portion 21 is so small as to satisfy the condition (1) such that the center electrode 20 tends to be low in breakage resistance. It is herein noted that, in the conditions (1) to (3), Lc is the length of the noble metal tip 70 in the direction of the axis; and Ls is the length of the small-diameter portion 23 in the direction of the axis as mentioned above.

$$Dg \leq 2.6 \quad (1)$$

$$1.15 \leq Lc+Ls \leq 3.0 \quad (2)$$

$$0.48 \leq Ls/(Lc+Ls) \leq 0.75 \quad (3)$$

It is possible to reduce the weight of the front end part of the center electrode 20 constituted by the noble metal tip 70 and the small-diameter portion 23 and further improve the breakage resistance of the center electrode 20 by satisfaction of the following condition (4).

$$0.61 \leq Ls/(Lc+Ls) \leq 0.75 \quad (4)$$

It is further possible to avoid the diameter Ds of the small-diameter portion 23 from becoming too large and ensure good ignition performance, while ensuring a certain degree of heat conduction from the noble metal tip 70 and preventing wearing of the noble metal tip 70, by satisfaction of the following condition (5). It is herein noted that, in the condition (5), Dc is the diameter of the noble metal tip 70; and Ds is the diameter of the small-diameter portion 23 as mentioned above.

$$Dc \leq Ds \leq Dc+0.4 \quad (5)$$

It is possible by satisfaction of the following condition (6) to, while avoiding the diameter Dg of the large-diameter portion 21 from becoming too small and preventing difficulty in processing and deterioration in durability, improve the breakage resistance of the center electrode 20 even when the diameter Dg of the large-diameter portion 21 is made smaller such that the center electrode 20 tends to be lower in breakage resistance.

$$1.7 \leq Dg \leq 2.3 \quad (6)$$

It is possible by satisfaction of the following condition (7) to further improve the breakage resistance of the center electrode 20 even when the diameter Dg of the large-diameter portion 21 is made smaller such that the center electrode 20 tends to be lower in breakage resistance.

$$1.7 \leq Dg \leq 1.9 \quad (7)$$

It is possible to further improve the breakage resistance of the center electrode 20 by satisfaction of the following condition (8) where X (mm) is the clearance between the center electrode 20 and the insulator (ceramic insulator 30) of the spark plug 300.

$$0.03 \leq X \leq 0.15 \quad (8)$$

Furthermore, it is possible by forming the boundary region 24 between the small-diameter portion 23 and the connection portion 22 of the center electrode 20 into a rounded profile to minimize deflection between the small-diameter portion 23 and the connection portion 22 even when an external force is applied to the center electrode 20.

B. Modifications and Changes

The configuration of the spark plug 300 according to the above exemplary embodiment is merely one example. Various modifications and changes of the above exemplary embodiment are possible. For example, the materials of the structural components of the spark plug 300 are not limited to the above-mentioned examples. Although the center electrode 20 had a two-layer structure formed with the covering region 25 and the core region 26 in the above exemplary embodiment, the center electrode 20 may alternatively be formed with a single-layer structure or three- or more layer structure.

In the above exemplary embodiment, the boundary of the small-diameter portion 23 and the noble metal tip 70 is made flat in a direction substantially perpendicular to the center axis of the spark plug 300 (see FIG. 4). Alternatively, the boundary of the small-diameter portion 23 and the noble metal tip 70 may be made uneven. In the case where the boundary of the small-diameter portion 23 and the noble metal tip 70 is made uneven, the length Ls of the small-diameter portion 23 and the length Lc of the noble metal tip 70 can be determined with respect to a flat boundary plane that extends through a frontmost point of the small-diameter portion 23 in a direction substantially perpendicular to the center axis of the spark plug 300

The present invention is not limited to the above exemplary embodiment and modification examples and can be embodied in various forms without departing from the scope of the present invention. It is feasible to appropriately replace or combine any of the technical features of the aspects of the present invention described in "Summary of the Invention" and the technical features of the above exemplary embodiment and modification examples of the present invention in order to solve part or all of the above-mentioned problems or achieve part or all of the above-mentioned effects. Any of these technical features, if not explained as essential in the present specification, may be deleted as appropriate.

DESCRIPTION OF REFERENCE NUMERALS

10: Ground electrode
11: Free end portion
12: Base end portion
20: Center electrode
21: Large-diameter portion
22: Connection portion
23: Small-diameter portion
24: Boundary region
25: Covering region
26: Core region
30: Ceramic insulator
31: Axial hole
32: Middle body portion
33: Rear body portion
34: Front body portion

35: Leg portion
40: Metal terminal
50: Metal shell
51: Tool engagement portion
52: Thread portion
53: Rear end portion
54: Seat portion
57: End face
59: Gasket
61: Ceramic insulator
62: Seal member
70: Noble metal tip
92: Fused zone
201: Thread hole
300: Spark plug
500: Engine head
OL: Axis Having described the invention, the following is claimed:

1. A spark plug comprising a center electrode, the center electrode having a small-diameter portion with a noble metal tip joined by laser welding to a front end of the small-diameter portion, a large-diameter portion made larger in diameter than the small-diameter portion and a connection portion connecting the small-diameter portion and the large-diameter portion to each other, wherein the spark plug satisfies the following conditions (1), (2) and (3):

$$Dg \leq 2.6 \quad (1)$$

$$1.15 \leq Lc+Ls \leq 3.0 \quad (2)$$

$$0.48 \leq Ls/(Lc+Ls) \leq 0.75 \quad (3)$$

where Dg (mm) is a diameter of the large-diameter portion; Lc (mm) is a length of the noble metal tip in an axis direction of the spark plug; and Ls (mm) is a length of the small-diameter portion in the axis direction of the spark plug; and wherein a boundary region between the small-diameter portion and the connection portion of the center electrode has a rounded profile.

2. The spark plug according to claim 1, wherein the spark plug satisfies the following condition (4):

$$0.61 \leq Ls/(Lc+Ls) \leq 0.75 \quad (4).$$

3. The spark plug according to claim 1, wherein the spark plug satisfies the following condition (5):

$$Dc \leq Ds \leq Dc+0.4 \quad (5)$$

where Dc (mm) is a diameter of the noble metal tip; and Ds (mm) is a diameter of the small-diameter portion.

4. The spark plug according to claim 1, wherein the spark plug satisfies the following condition (6):

$$1.7 \leq Dg \leq 2.3 \quad (6).$$

5. The spark plug according to claim 4, wherein the spark plug satisfies the following condition (7):

$$1.7 \leq Dg \leq 1.9 \quad (7).$$

6. The spark plug according to claim 1, wherein the spark plug satisfies the following condition (8):

$$0.03 \leq X \leq 0.15 \quad (8)$$

where X (mm) is a clearance between the center electrode and an insulator of the spark plug.

7. The spark plug according to claim 1, wherein the small-diameter portion has a cylindrical column shape; and wherein the connection portion has a tapered shape.

* * * * *